US007764921B2

(12) United States Patent
Horiguchi et al.

(10) Patent No.: US 7,764,921 B2
(45) Date of Patent: Jul. 27, 2010

(54) METHOD AND APPARATUS HAVING IMPROVED SHEET EJECTION SYSTEM

(75) Inventors: Shigeru Horiguchi, Kawasaki (JP); Makoto Kurata, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 1167 days.

(21) Appl. No.: 11/377,559

(22) Filed: Mar. 17, 2006

(65) Prior Publication Data

US 2006/0210336 A1 Sep. 21, 2006

(30) Foreign Application Priority Data

Mar. 17, 2005 (JP) ..... 2005-076250

(51) Int. Cl.
*G03G 15/00* (2006.01)

(52) U.S. Cl. ..... 399/405; 399/9; 399/16; 399/107

(58) Field of Classification Search ..... 399/9, 399/16, 81
See application file for complete search history.

(56) References Cited

U.S. PATENT DOCUMENTS

| | | | | |
|---|---|---|---|---|
| 5,836,579 | A * | 11/1998 | Hayashi et al. | 270/58.16 |
| 6,075,958 | A | 6/2000 | Gotoh et al. | |
| 6,113,094 | A | 9/2000 | Horiguchi et al. | |
| 6,128,455 | A | 10/2000 | Horiguchi et al. | |
| 6,260,843 | B1 | 7/2001 | Hoshimura et al. | |
| 6,328,298 | B1 | 12/2001 | Suzuki et al. | |
| 6,486,419 | B2 | 11/2002 | Horiguchi et al. | |
| 6,690,901 | B2 * | 2/2004 | Katsuyama et al. | 399/107 |
| 6,736,392 | B1 | 5/2004 | Horiguchi et al. | |
| 6,755,733 | B2 | 6/2004 | Horiguchi et al. | |
| 2001/0009625 | A1 * | 7/2001 | Tamehira et al. | 399/405 |
| 2006/0018692 | A1 * | 1/2006 | Kubo | 399/405 |

FOREIGN PATENT DOCUMENTS

| | | |
|---|---|---|
| JP | 03-162365 | 7/1991 |
| JP | 05-070028 | 3/1993 |
| JP | 08-337349 | 12/1996 |
| JP | 11-193166 | 7/1999 |
| JP | 2001-180864 | 7/2001 |
| JP | 2004-161410 | 6/2004 |
| JP | 2004-252510 | 9/2004 |
| JP | 2006-30763 | 2/2006 |

* cited by examiner

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

An image forming apparatus includes an image reader, an image forming unit, an output portion, and a notifying mechanism for notifying the operator of the apparatus. The image reader is configured to read an image on an original sheet to create image data. The image forming unit is configured to form a toner image on a sheet according to the image data. The output portion is disposed between the image reader and the image forming unit and includes a bin tray configured to receive the sheet having the toner image. The notifying mechanism includes a signal generator and a notifying member. The signal generator is configured to generate a signal when the sheet is output onto the bin tray. The notifying member is configured to notify that the sheet is output on the bin tray in accordance with the signal generated by the signal generator.

11 Claims, 5 Drawing Sheets

METHOD AND APPARATUS HAVING IMPROVED SHEET EJECTION SYSTEM

CROSS-REFERENCE TO RELATED APPLICATION

The present application is based on and claims priority to Japanese patent application No. 2005-076250filed on Mar. 17, 2005 in the Japan Patent Office, the entire contents of which are hereby incorporated herein by reference.

BACKGROUND OF THE INVENTION

1. Field of the Invention

The present invention relates to a method and an apparatus, and more particularly to a method and an apparatus having an improved sheet ejection system.

2. Description of the Background Art

A background image forming apparatus, such as a copying machine or a facsimile machine, generally includes an image reader for reading an image on an original sheet to create image data, an image forming unit for forming a toner image on a sheet based on the image data, and an output portion for receiving sheets having the toner image formed by the image forming unit. The output portion may include an internal output portion which is disposed between the image reader and the image forming unit. The internal output portion includes a bin tray on which sheets having the toner image are output and stacked. Namely, the bin tray is located far from a display for indicating that the sheets having the toner image are stacked on the bin tray. Therefore, an operator of the background image forming apparatus, even when looking at the display, may not easily recognize that the sheets having the toner image are stacked on the bin tray.

In one example of the background image forming apparatus, the internal output portion includes at least one bin tray. Sheets are output onto either the bin tray or a bottom surface of the internal output portion by using a switcher for switching between the bin tray and the bottom surface of the internal output portion. A part of the bin tray, which faces an operator of the image forming apparatus who picks up the sheets, is cut out so that the operator may easily find through the cut-out part that the sheets are output on the bottom surface of the internal output portion. The display is also disposed facing the operator who picks up the sheets.

Another example of the background image forming apparatus includes a plurality of bin trays, a sensor for detecting sheets output on each of the bin trays, and a mover for moving any one of the bin trays to an outlet through which sheets are delivered onto the bin tray. When the sensor detects that the bin tray connected to the outlet is full and can receive no more sheets, the mover moves any other bin tray present which can receive more sheets to the outlet.

Yet another example of the background image forming apparatus includes a plurality of slanted bin trays layered in a vertical direction. One of the slanted bin trays is moved in a substantially horizontal direction to create a greater clearance from other bin tray disposed above and thereby easily receive sheets.

SUMMARY OF THE INVENTION

This specification describes a novel image forming apparatus. In one aspect of the present invention, the novel image forming apparatus includes an image reader, an image forming unit, an output portion, and a notifying mechanism. The image reader is configured to read an image on an original sheet to create image data. The image forming unit is configured to form a toner image on a sheet according to the image data. The output portion is disposed between the image reader and the image forming unit and includes a bin tray configured to receive the sheet having the toner image. The notifying mechanism includes a signal generator and a notifying member. The signal generator is configured to generate a signal when the sheet is output onto the bin tray. The notifying member is configured to notify that the sheet is output on the bin tray in accordance with the signal generated by the signal generator.

This specification further describes a novel image forming method. In one aspect of the present invention, the novel image forming method includes reading an image on an original sheet to create image data, forming a toner image on a sheet according to the image data, receiving the sheet having the toner image on a bin tray of an output portion disposed between an image reader and an image forming unit, generating a signal when the sheet is output onto the bin tray, and notifying the operator that the sheet is output on the bin tray in accordance with the generated signal.

This specification further describes a novel notifying system. In one aspect of the present invention, the novel notifying system includes a signal generator and a notifying member. The signal generator is configured to generate a signal when a sheet is output onto a bin tray. The notifying member is configured to notify that the sheet is output on the bin tray in accordance with the signal generated by the signal generator.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
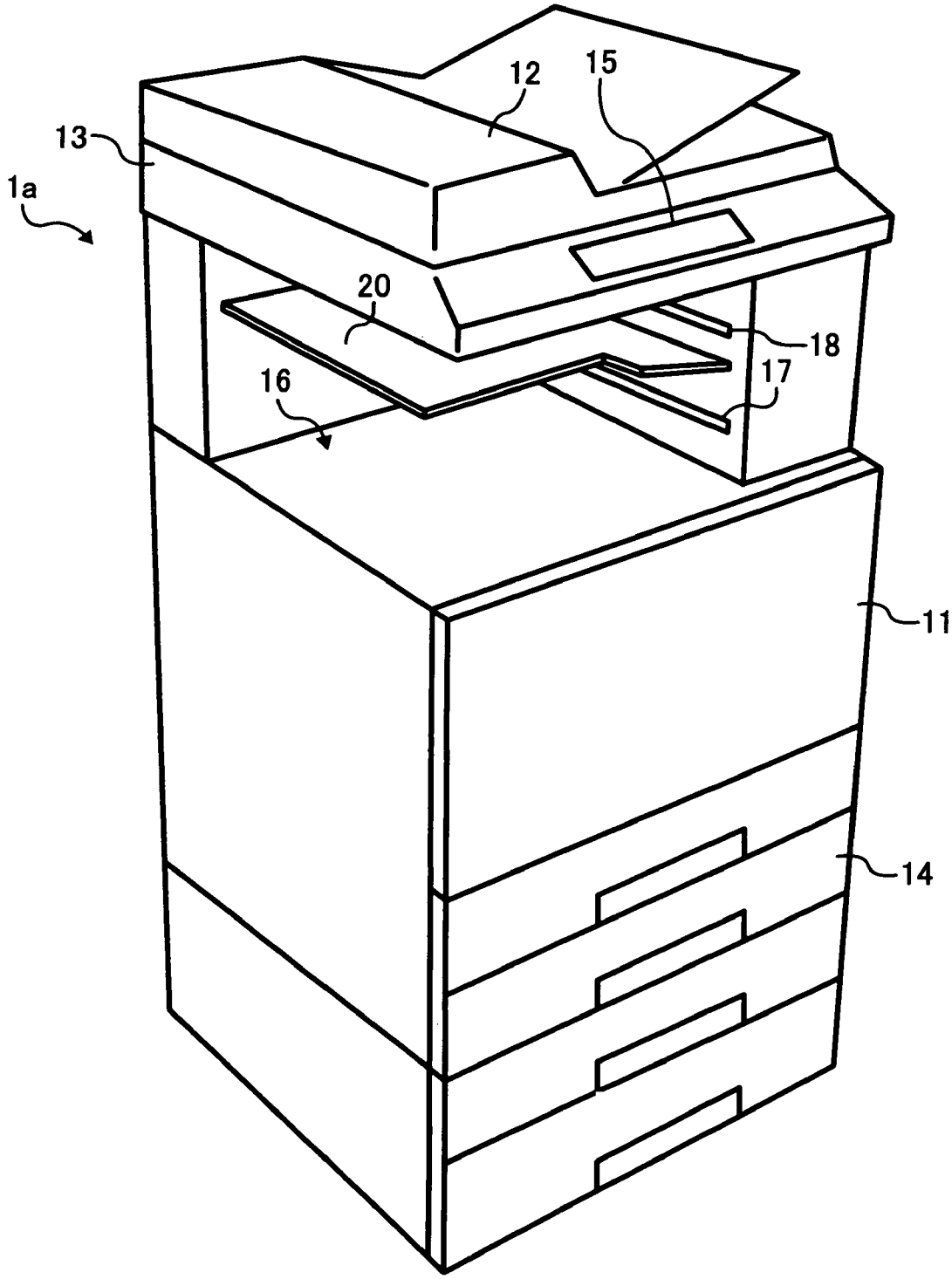
FIG. 1 is a perspective view of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 1*a* according to an exemplary embodiment of the present invention is explained.

As illustrated in FIG. 1, the image forming apparatus 1*a* includes a control panel 15, an auto document feeder 12, an image reader 13, a paper tray 14, an image forming unit 11, exit openings 17 and 18, and an internal output portion 16.

The image forming apparatus 1*a* forms an image according to an electrophotographic method, for example and functions as a copying machine, a facsimile machine, or the like. The control panel 15 is operated by an operator of the image forming apparatus 1*a* to input information about a job. The auto document feeder 12 loads original sheets and feeds the original sheets one by one toward the image reader 13. The image reader 13 reads an image on the original sheet to create image data and sends the image data to the image forming unit 11. The paper tray 14 loads sheets to be sent to the image forming unit 11. The image forming unit 11 forms an electrostatic latent image based on the image data and visualizes the electrostatic latent image with toner to form a toner image. A transferor (not shown) transfers the toner image onto the sheet sent from the paper tray 14. A fixing unit (not shown) fixes the toner image on the sheet. The sheet having the fixed toner image is conveyed to the internal output portion 16 through the exit opening 17 or the exit opening 18. The internal output portion 16 receives the sheet having the fixed toner image.

The exit opening 17, the exit opening 18, and the internal output portion 16 are disposed between the image reader 13 and the image forming unit 11. The internal output portion 16 includes a bin tray 20. The bin tray 20 receives the sheet having the fixed toner image conveyed through the exit opening 18.

Figure 2:
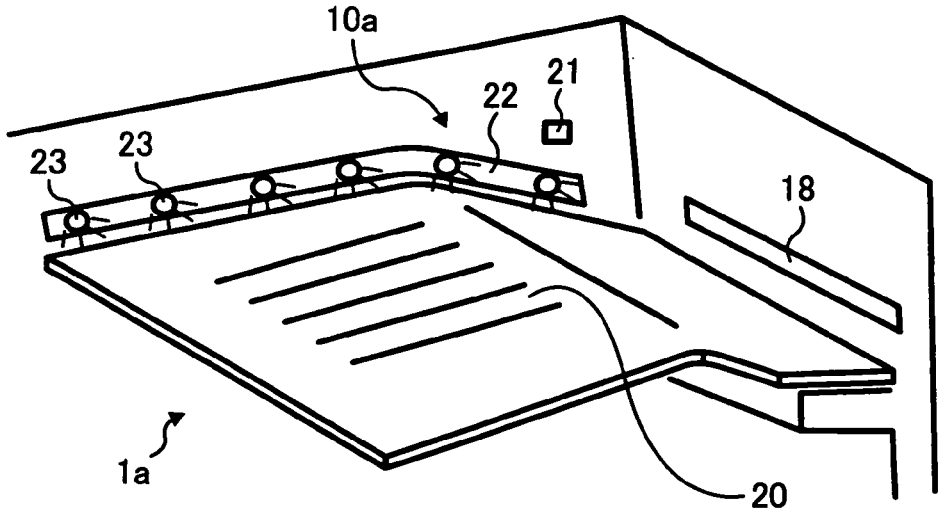
FIG. 2 is a perspective view of a notifying mechanism of the image forming apparatus shown in FIG. 1.

FIG. 2 illustrates a notifying mechanism 10*a* according to this non-limiting embodiment of the present invention. As illustrated in FIG. 2, the image forming apparatus 1*a* further includes the notifying mechanism 10*a* for notifying the operator that sheets are stacked on the bin tray 20 and including a signal generator and a notifying member. The signal generator generates a signal when sheets are stacked on the bin tray 20 and the notifying member notifies the operator that the sheets are stacked on the bin tray 20 in accordance with the signal generated by the signal generator. The notifying mechanism 10*a* includes a photo sensor 21 and a light emitter 22. The photo sensor 21 detects sheets output on the bin tray 20 and functions as the signal generator. The signal generator may further include a controller for controlling operations of the image forming apparatus 1*a*, an ultrasonic sensor, a contact sensor, and a non-contact sensor disposed on the bin tray 20 or the other parts of the image forming apparatus 1*a*. The light emitter 22 includes a plurality of light emitting diodes 23 for irradiating light onto an upper surface of the bin tray 20 and functions as the notifying member. The bin tray 20 may include a plastic material or any other material which is transparent or translucent.

When the sheets are output onto the bin tray 20, the light emitter 22 emits light in accordance with the signal generated by the signal generator. The light is irradiated onto the upper surface of the bin tray 20. The surface of the bin tray 20 is illuminated and becomes brighter than the other parts of the image forming apparatus 1*a*. The illuminated bin tray 20 may be noticeable to the operator and may attract the attention of the operator. Thus, the operator may easily recognize that the sheets are output on the bin tray 20. When the light emitter 22 emits red light or the like, the bin tray 20 is illuminated in such color and may become more noticeable to the operator.

Figure 3:
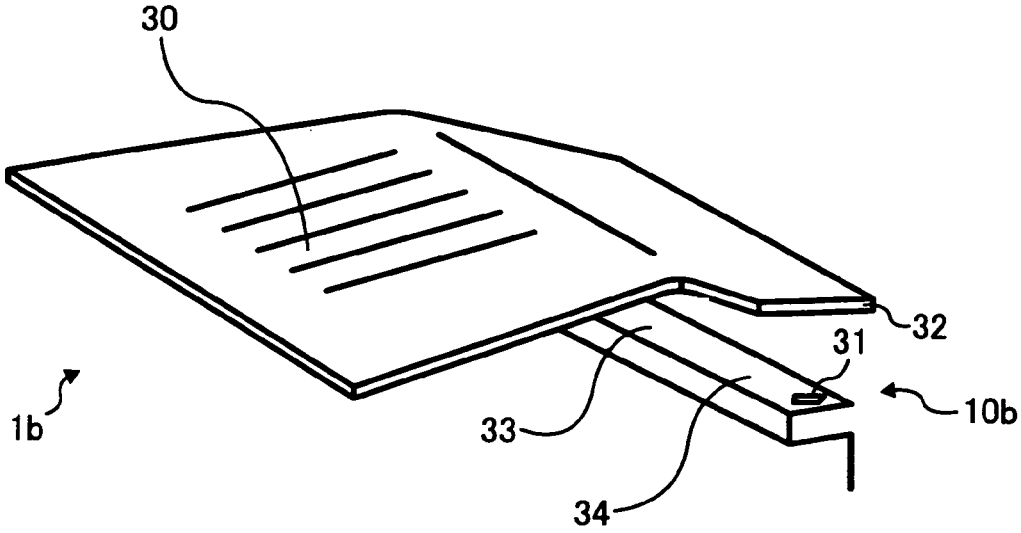
FIG. 3 is a perspective view of a notifying mechanism according to another exemplary embodiment of the present invention.

FIG. 3 illustrates an image forming apparatus 1*b* according to another exemplary embodiment of the present invention. As illustrated in FIG. 3, the image forming apparatus 1*b* includes a notifying mechanism 10*b* replacing the notifying mechanism 10*a* and a bin tray 30 replacing the bin tray 20. The notifying mechanism 10*b* includes a light emitter 31, a bin tray support 33, and a signal transmitter 34. The bin tray 30 includes a light surface 32.

The light emitter 31 includes a light emitting diode. The bin tray support 33 supports the bin tray 30. The signal transmitter 34 is disposed on the bin tray support 33 and transmits a signal to the light emitter 31 and the bin tray 30. The light surface 32 is disposed on a side of the bin tray 30, which faces the operator when the operator stands in front of the image forming apparatus 1*b* to operate the image forming apparatus 1*b*. Light emitted from the light emitter 31 illuminates the light surface 32. The notifying mechanism 10*b* further includes a signal generator similar to that of the notifying mechanism 10*a*.

When the sheets are output onto the bin tray 30, the light emitter 31 emits light in accordance with a signal generated by the signal generator. The light is irradiated toward the light surface 32 and emitted from the light surface 32. The light surface 32 is illuminated and becomes brighter than the other parts of the image forming apparatus 1*b*. The illuminated bin tray 30 may be noticeable to the operator and may attract the attention of the operator. Thus, the operator may easily recognize that the sheets are output on the bin tray 30. When the light emitter 31 emits red light or the like, the light surface 32 is illuminated in such color and may become more noticeable to the operator.

Figure 4:
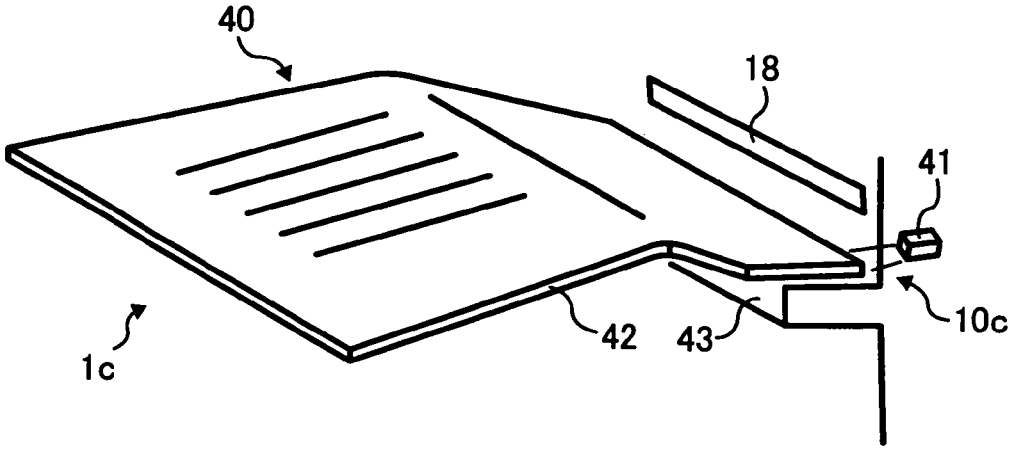
FIG. 4 is a perspective view of a notifying mechanism according to yet another exemplary embodiment of the present invention.

FIG. 4 illustrates an image forming apparatus 1*c* according to yet another exemplary embodiment of the present invention. As illustrated in FIG. 4, the image forming apparatus 1*c* includes a notifying mechanism 10*c* replacing the notifying mechanism 10*a* and a bin tray 40 replacing the bin tray 20. The notifying mechanism 10*c* includes a light emitter 41 and a bin tray support 43. The bin tray 40 includes a light surface 42.

The light emitter 41 includes a light emitting diode and is disposed near a side of the bin tray support 43, which faces the operator when the operator stands in front of the image forming apparatus 1*c* to operate the image forming apparatus 1*c* . The bin tray support 43 supports the bin tray 40. The light surface 42 is disposed on a side of the bin tray 40, which faces the operator when the operator stands in front of the image forming apparatus 1*c* to operate the image forming apparatus 1*c* . Light emitted from the light emitter 41 illuminates the light surface 42. The notifying mechanism 10*c* further includes a signal generator similar to that of the notifying mechanism 10*a*.

When the sheets are output onto the bin tray 40, the light emitter 41 emits light in accordance with a signal generated by the signal generator. The light is irradiated toward the light surface 42 and emitted from the light surface 42. The light surface 42 is illuminated and becomes brighter than the other parts of the image forming apparatus 1*c* . The illuminated bin tray 40 may be noticeable to the operator and may attract attention of the operator. Thus, the operator may easily recognize that the sheets are output on the bin tray 40. When the light emitter 41 emits red light or the like, the light surface 42 is illuminated in such color and may become more noticeable to the operator.

Figure 5:
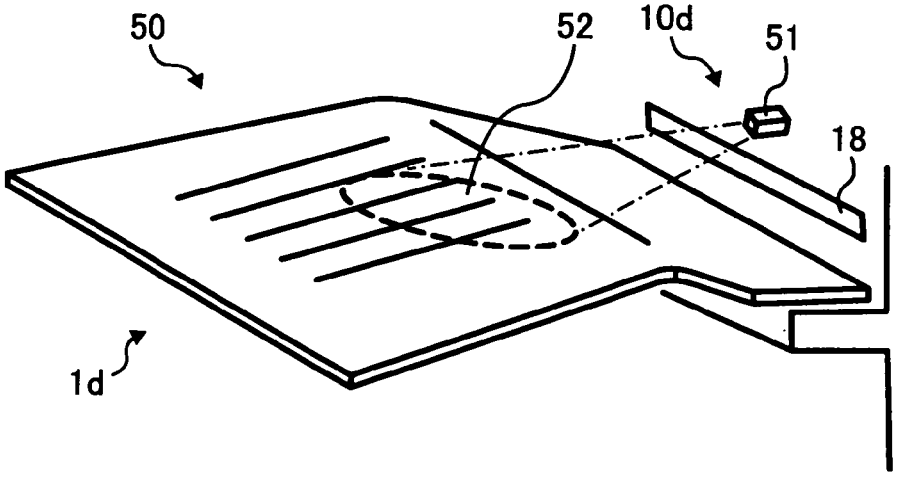
FIG. 5 is a perspective view of a notifying mechanism according to yet another exemplary embodiment of the present invention.

FIG. 5 illustrates an image forming apparatus 1*d* according to yet another exemplary embodiment of the present invention. As illustrated in FIG. 5, the image forming apparatus 1*d* includes a notifying mechanism 10*d* replacing the notifying mechanism 10*a* and a bin tray 50 replacing the bin tray 20. The notifying mechanism 10*d* includes a light emitter 51. The bin tray 50 includes an area 52.

The light emitter 51 includes a light emitting diode and irradiates light onto an upper surface of the bin tray 50. The area 52 is formed on the upper surface of the bin tray 50 onto which the light is irradiated. The notifying mechanism 10*d* further includes a signal generator similar to that of the notifying mechanism 10*a*.

When the sheets are output onto the bin tray 50, the light emitter 51 emits light in accordance with a signal generated by the signal generator. The light is irradiated onto the area 52. The area 52 is illuminated and becomes brighter than the other parts of the image forming apparatus 1*d*. The bin tray 50 having the illuminated area 52 may be noticeable to the operator and may attract attention of the operator. Thus, the operator may easily recognize that the sheets are output on the bin tray 50. When the light emitter 51 emits red light or the like, the area 52 is illuminated in such color and may become more noticeable to the operator.

Figure 6:
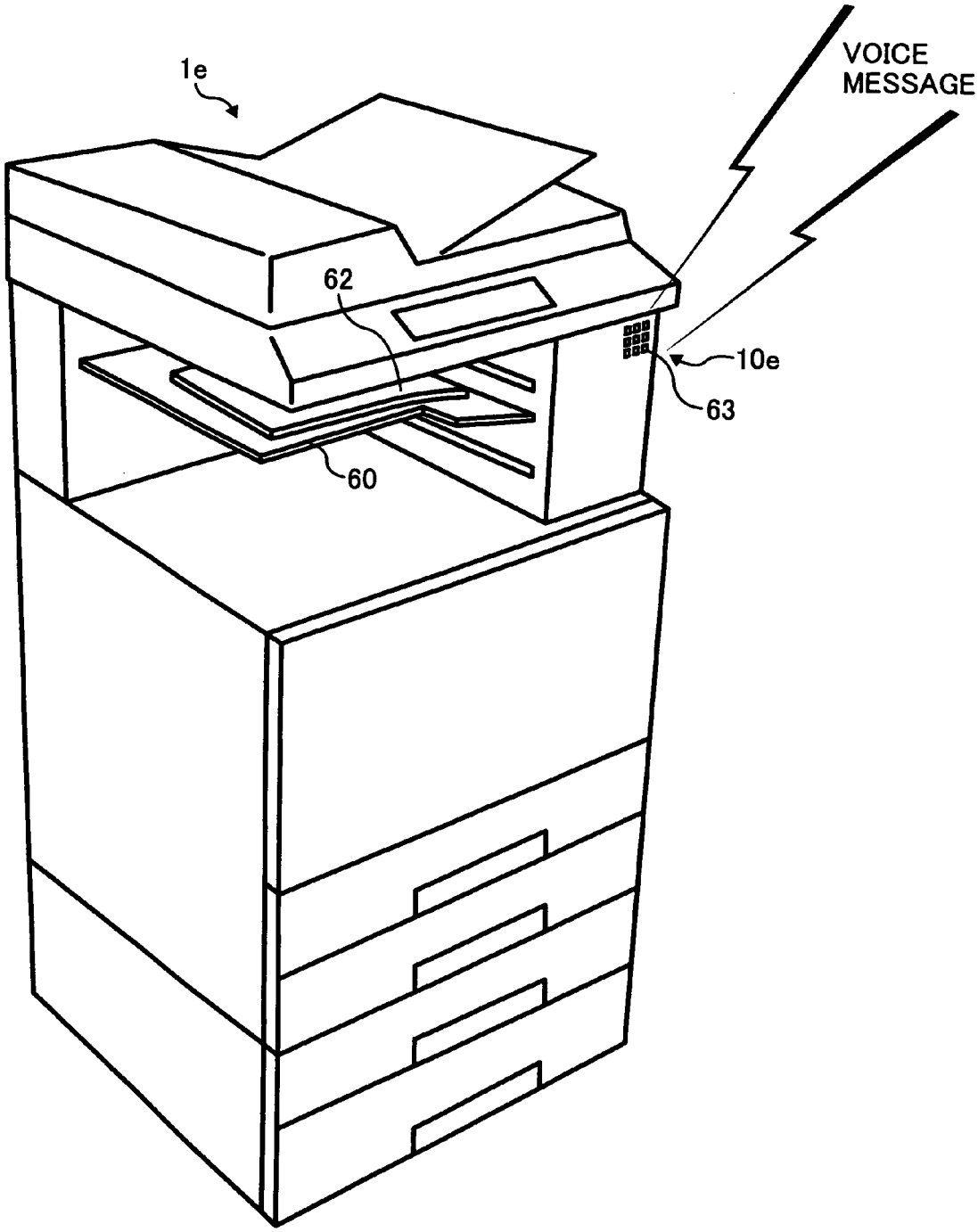
FIG. 6 is a perspective view of an image forming apparatus according to another exemplary embodiment of the present invention.

FIG. 6 illustrates an image forming apparatus 1*e* according to yet another exemplary embodiment of the present invention. As illustrated in FIG. 6, the image forming apparatus 1*e* includes a notifying mechanism 10*e* replacing the notifying mechanism 10*a* and a bin tray 60 replacing the bin tray 20. The notifying mechanism 10*e* includes a voice generator 63 and a signal generator similar to that of the notifying mechanism 10*a*.

The voice generator 63 generates a voice message notifying the operator that sheets 62 are stacked on the bin tray 60 in accordance with a signal generated by the signal generator. When the sheets 62 are output onto the bin tray 60 after the image forming apparatus 1*e* receives facsimile data, for example, the voice generator 63 generates the voice message in a predetermined language to the operator, such as "The bin tray has received a facsimile message." A known voice generator may be used as the voice generator 63. The operator may select one or more desired languages from a plurality of languages preset. The voice message varies depending on operations of the image forming apparatus 1*e*.

When hearing the voice message generated by the voice generator 63, the operator may look at the bin tray 60 and may easily recognize that the sheets 62 are output on the bin tray 60.

Figure 7:
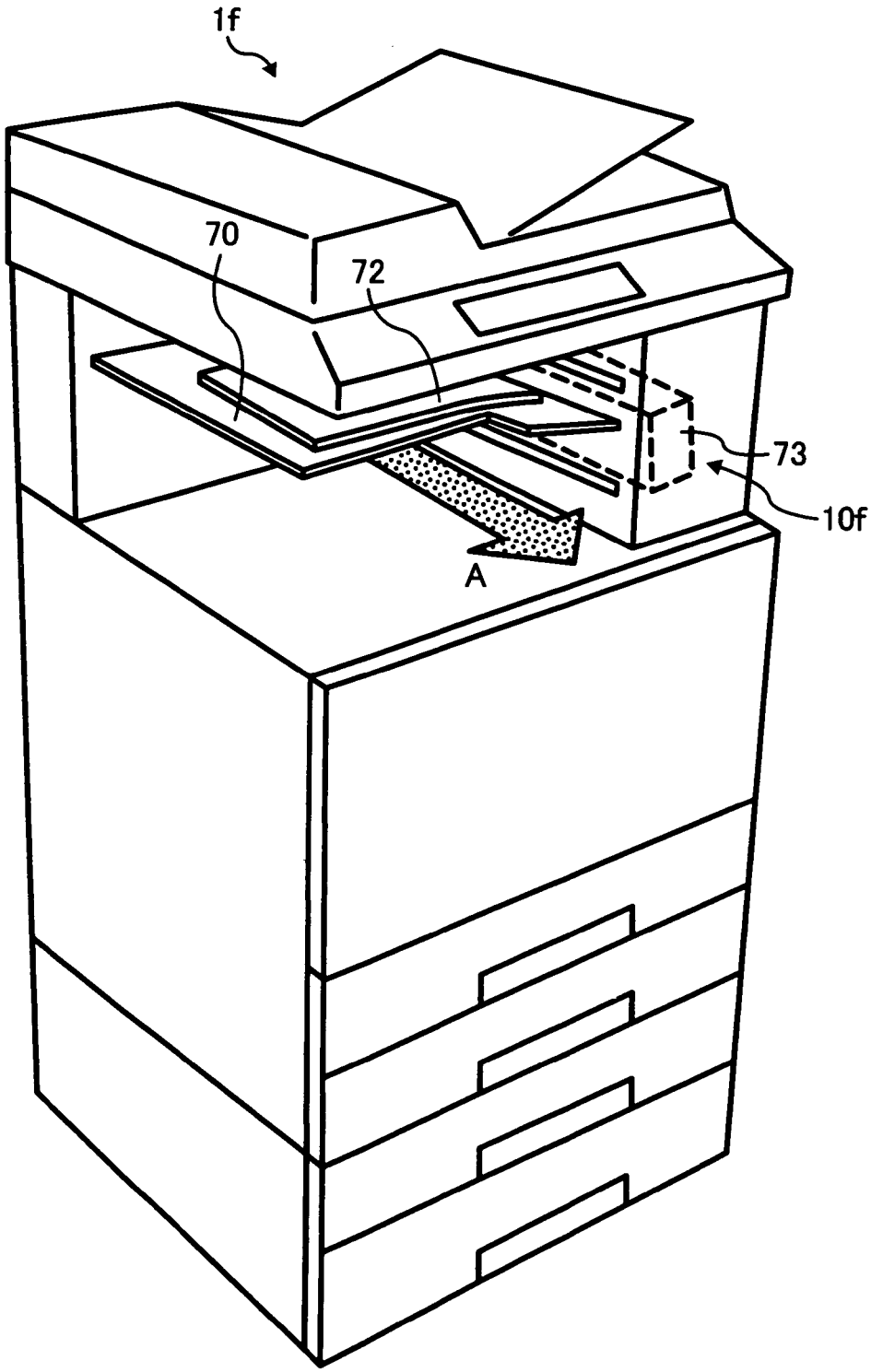
FIG. 7 is a perspective view of an image forming apparatus according to yet another exemplary embodiment of the present invention.

FIG. 7 illustrates an image forming apparatus 1*f* according to yet another exemplary embodiment of the present invention. As illustrated in FIG. 7, the image forming apparatus 1*f* includes a notifying mechanism 10*f* replacing the notifying mechanism 10*a* and a bin tray 70 replacing the bin tray 20. The notifying mechanism 10*f* includes a bin tray mover 73 and a signal generator similar to that of the notifying mechanism 10*a*.

The bin tray mover 73 moves the bin tray 70 carrying sheets 72 toward the operator standing in front of the image forming apparatus 1*f* to operate the image forming apparatus 1*f* in accordance with a signal generated by the signal generator when the sheets 72 are completely stacked on the bin tray 70.

When the sheets 72 are output onto the bin tray 70, the bin tray mover 73 moves the bin tray 70 in a direction A in accordance with the signal generated by the signal generator. The bin tray 70 moved toward the operator may be noticeable to the operator and may attract the attention of the operator. Thus, the operator may easily recognize that the sheets 72 are output on the bin tray 70.

The present invention has been described above with reference to specific embodiments. Note that the present invention is not limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

What is claimed is:

1. An image forming apparatus, comprising:

an image reader configured to read an image on an original sheet to create image data;

an image forming unit configured to form a toner image on a sheet according to the image data;

an output portion disposed between the image reader and the image forming unit and including, a bin tray configured to receive the sheet having the toner image; and a notifying mechanism, including, a signal generator configured to generate a signal when the sheet is output onto the bin tray, and a notifying member configured to notify an operator operating the image forming apparatus that the sheet is output on the bin tray in accordance with the signal generated by the signal generator, wherein the notifying member includes a bin tray mover configured to move the bin tray carrying the sheet toward an operator operating the image forming apparatus.

2. The image forming apparatus according to claim 1, wherein the notifying member includes a light emitter configured to emit light.

3. The image forming apparatus according to claim 2, wherein the light emitter irradiates light toward a side of the bin tray facing the operator operating the image forming apparatus to cause the side of the bin tray to emit the light.

4. The image forming apparatus according to claim 2, wherein the light emitter irradiates light toward an upper surface of the bin tray at a horizontal angle.

5. The image forming apparatus according to claim 2, wherein the light emitter irradiates light toward a surface of the bin tray.

6. The image forming apparatus according to claim 2, wherein the bin tray includes any one of transparent and translucent materials.

7. The image forming apparatus according to claim 1, wherein the notifying member includes a voice generator configured to generate a voice.

8. The image forming apparatus according to claim 7, wherein the voice generator generates a voice message notifying the operator that the sheet is output on the bin tray in a predetermined language.

9. The image forming apparatus according to claim 8, wherein the voice generator generates the voice message in any one of a single language and a plurality of languages selected from a plurality of preset languages.

10. An image forming apparatus, comprising:

means for reading an image on an original sheet to create image data;

means for forming a toner image on a sheet according to the image data;

means for being disposed between the means for reading and the means for forming and including, means for receiving the sheet having the toner image; and means for notifying, including, means for generating a signal when the sheet is output onto the means for receiving, and means for notifying to an operator of the image forming apparatus that the sheet is output on the means for receiving in accordance with the signal generated by the means for generating, wherein the means for notifying includes a bin tray mover configured to move the means for receiving carrying the sheet toward an operator operating the image forming apparatus.

11. An image forming apparatus, comprising:

a scanner;

a printing device;

an output tray disposed between the scanner and the printing device;

a light emitter which emits light onto paper on the output tray to attract attention of an operator in response to a signal; and a signal generator which generates the signal causing the light to emit onto the paper on the output tray in response to the paper being printed on by the printing device and ejected on the output tray.

* * * * *